US010338502B2

(12) United States Patent
Hirado et al.

(10) Patent No.: US 10,338,502 B2
(45) Date of Patent: Jul. 2, 2019

(54) IMAGE-FORMING APPARATUS

(71) Applicant: CANON KABUSHIKI KAISHA, Tokyo (JP)

(72) Inventors: Yasuharu Hirado, Tokyo (JP); Yusaku Iwasawa, Mishima (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 16/039,636

(22) Filed: Jul. 19, 2018

(65) Prior Publication Data

US 2019/0041775 A1 Feb. 7, 2019

(30) Foreign Application Priority Data

Aug. 1, 2017 (JP) ..... 2017-149278
May 23, 2018 (JP) ..... 2018-099170

(51) Int. Cl.
*G03G 15/16* (2006.01)

(52) U.S. Cl.
CPC ..... *G03G 15/161* (2013.01); *G03G 15/1605* (2013.01); *G03G 15/1665* (2013.01); *G03G 2215/1661* (2013.01)

(58) Field of Classification Search
CPC ..... G03G 15/161; G03G 2215/1661; G03G 2221/0073; G03G 15/1605; G03G 15/1665
See application file for complete search history.

(56) References Cited

U.S. PATENT DOCUMENTS

2008/0187369 A1* 8/2008 Nakagawa ..... G03G 21/0047 399/310
2009/0232530 A1* 9/2009 Saito ..... G03G 15/161 399/50
2015/0362866 A1* 12/2015 Matsushita ..... G03G 15/161 399/44
2016/0282767 A1* 9/2016 Yagi ..... G03G 15/161

FOREIGN PATENT DOCUMENTS

JP 2009205012 A 9/2009
JP 2012203388 A 10/2012
JP 2013246365 A 12/2013
JP 2013246370 A 12/2013
JP 2014032294 A 2/2014
JP 2016173503 A 9/2016
JP 2016180963 A 10/2016

* cited by examiner

*Primary Examiner* — Carla J Therrien
(74) *Attorney, Agent, or Firm* — Canon U.S.A., Inc. IP Division

(57) ABSTRACT

An image-forming apparatus includes a charging unit that charges toner with polarity opposite to a normal charging polarity of the toner and a control unit that performs collection operation for the toner charged with the opposite polarity by the charging unit. The control unit causes a first power supply to apply a first voltage having the opposite polarity to a first transfer member while first and second image bearing members are in contact with an intermediate transfer member. The control unit causes the first power supply to apply a second voltage having the opposite polarity and higher in absolute value than the first voltage to the first transfer member while the first image bearing member is in contact with the intermediate transfer member and the second image bearing member is separated from the intermediate transfer member.

16 Claims, 7 Drawing Sheets

IMAGE-FORMING APPARATUS

BACKGROUND OF THE INVENTION

Field of the Invention

The disclosure relates to an image-forming apparatus employing an electrophotographic process, such as a copier or a printer.

Description of the Related Art

In a color image-forming apparatus that employs an electrophotographic process, a configuration in which image forming sections corresponding to various colors transfer toner images consecutively onto an intermediate transfer member and then transfer the toner images from the intermediate transfer member onto a transfer medium is known.

In such an image-forming apparatus, the image forming section for each color has a drum-shaped photosensitive member (hereinafter referred to as a "photosensitive drum"), which serves as an image bearing member. A toner image formed on the photosensitive drum of the image forming section for each color is primary-transferred onto the intermediate transfer member, such as an intermediate transfer belt, while a primary transfer power supply applies a voltage to a primary transfer member that is disposed so as to oppose the photosensitive drum with the intermediate transfer member interposed therebetween. The image forming section for each color primary-transfers each color toner image onto the intermediate transfer member. Each color toner image is subsequently secondary-transferred from the intermediate transfer member onto a transfer medium, such as a sheet of paper or an OHP sheet, while a secondary transfer power supply applies a voltage to a secondary transfer member in a secondary transfer portion. Each color toner image transferred onto the transfer medium is subsequently fixed on the transfer medium in a fixing unit.

Japanese Patent Laid-Open No. 2009-205012 discloses a configuration in which cleaning of the intermediate transfer member is performed in such a manner that residual toner remaining on the intermediate transfer member (i.e., residual toner) after a toner image is secondary-transferred onto a transfer medium is collected electrostatically by a photosensitive drum. In this configuration, a charging member is disposed downstream of the secondary transfer member with respect to the movement direction of the intermediate transfer member. Residual toner is charged when the residual toner passes through a region where the charging member and the intermediate transfer member are in contact with each other. The residual toner subsequently moves together with the intermediate transfer member to a region where the photosensitive drum and the intermediate transfer member are in contact with each other. In this region, the residual toner is transferred in reverse from the intermediate transfer member to the photosensitive drum due to a potential difference between the photosensitive drum and the intermediate transfer member. The residual toner that has been moved onto the photosensitive drum is collected by a cleaning unit that is disposed beside the photosensitive drum and consequently removed from the photosensitive drum.

However, in the configuration according to Japanese Patent Laid-Open No. 2009-205012, when the charging member charges the residual toner, the intermediate transfer member is charged simultaneously. As a result, the potential of the intermediate transfer member increases gradually. As the potential of the intermediate transfer member increases, the potential difference between the photosensitive drum and the intermediate transfer member may become insufficient such that a portion of the residual toner may pass through the region where the photosensitive drum is in contact with the intermediate transfer member, which may result in faulty cleaning.

For example, in the case in which a plurality of photosensitive drums is in contact with the intermediate transfer member, photosensitive drums located downstream with respect to the movement direction of the intermediate transfer member can collect residual toner even if an upstream photosensitive drum does not fully collect the residual toner. On the other hand, in the case in which a single photosensitive drum is in contact with the intermediate transfer member, faulty cleaning may occur if the residual toner passes through the region where the photosensitive drum is in contact with the intermediate transfer member.

SUMMARY OF THE INVENTION

The disclosure provides a favorable cleaning performance in an image-forming apparatus that collects residual toner on an intermediate transfer member by using an image bearing member regardless of the number of image bearing members that are in contact with the intermediate transfer member.

The disclosure provides an image-forming apparatus that includes a first image bearing member that bears a toner image, a second image bearing member that bears a toner image, an intermediate transfer member that is movable and onto which a toner image born by at least one of the first image bearing member and the second image bearing member is primary-transferred, a first transfer member that is in contact with an inner peripheral surface of the intermediate transfer member and is disposed at a position corresponding to the first image bearing member, a first power supply that applies a voltage to the first transfer member, a charging unit that is in contact with an outer peripheral surface of the intermediate transfer member and is disposed, with respect to a movement direction of the intermediate transfer member, downstream of a secondary transfer portion where the toner image is secondary-transferred from the intermediate transfer member onto a transfer medium and that charges toner that has passed the secondary transfer portion with opposite polarity that is opposite to a normal charging polarity of the toner, and a control unit that can perform a collection operation in which the toner charged with the opposite polarity by the charging unit is moved from the intermediate transfer member to any one of the first and second image bearing members that are in contact with the intermediate transfer member. In the image-forming apparatus, the control unit performs the collection operation by causing the first power supply to apply a first voltage that is a voltage having the opposite polarity to the first transfer member in a first state in which the first image bearing member and the second image bearing member are in contact with the intermediate transfer member, and the control unit performs the collection operation by causing the first power supply to apply a second voltage that is a voltage having the opposite polarity and higher in absolute value than the first voltage to the first transfer member in a second state in which the first image bearing member is in contact with the intermediate transfer member and the second image bearing member is separated from the intermediate transfer member.

Further features and aspects of the disclosure will become apparent from the following description of numerous example embodiments with reference to the attached drawings.

DESCRIPTION OF THE EMBODIMENTS

Numerous embodiments, features and aspects of the disclosure will be described with reference to the drawings. Note that dimensions, materials, shapes, relative positions, or the like, of elements described in the embodiments below are to be changed appropriately in accordance with configurations and various conditions of an apparatus to which the disclosure is applied, and accordingly, the embodiments described below should not be construed as limiting the invention.

First Embodiment

Configuration of Image-Forming Apparatus

Figure 1:
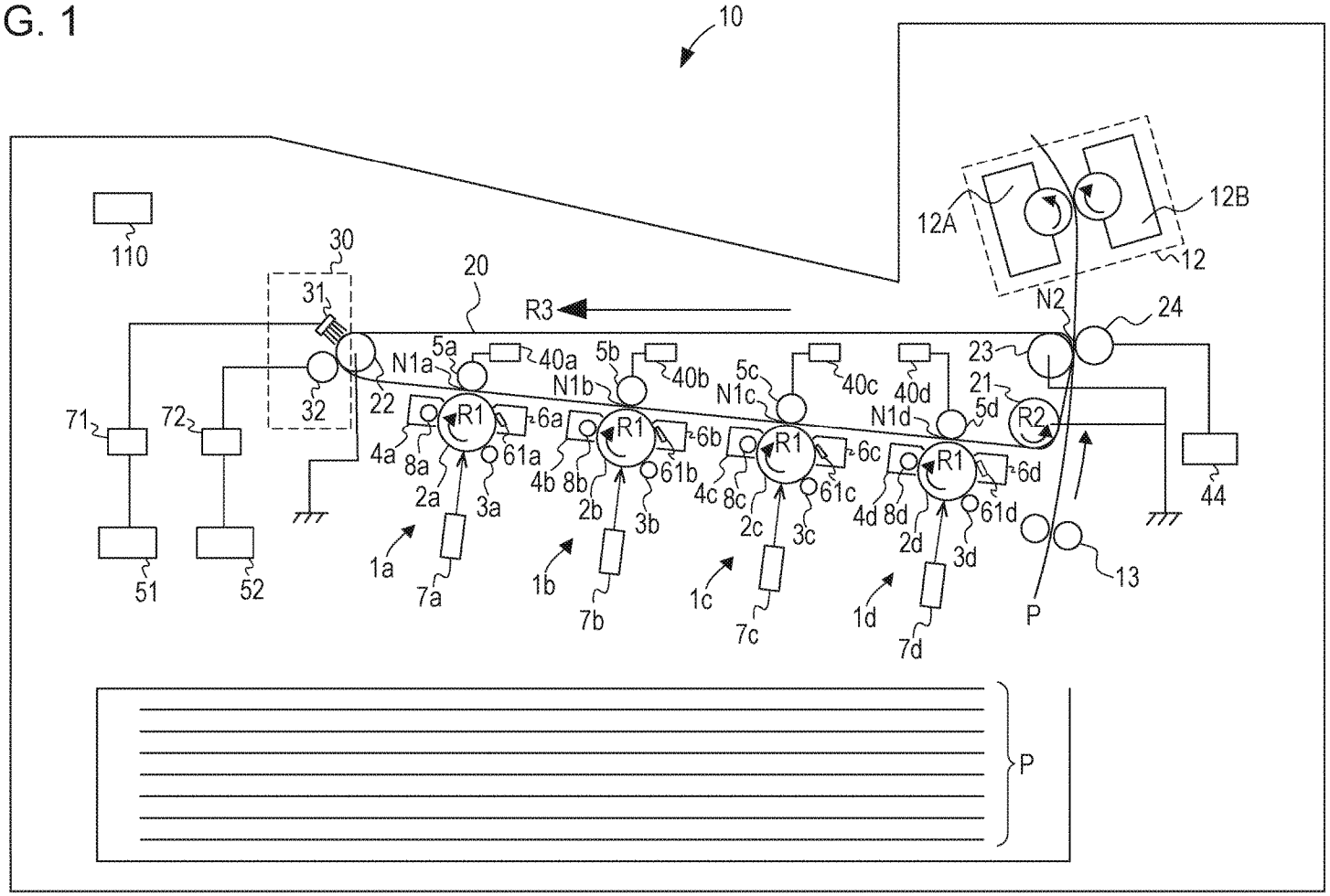
FIG. 1 is a cross-sectional view schematically illustrating an example configuration of an image-forming apparatus according to the first embodiment.
Figure 2:
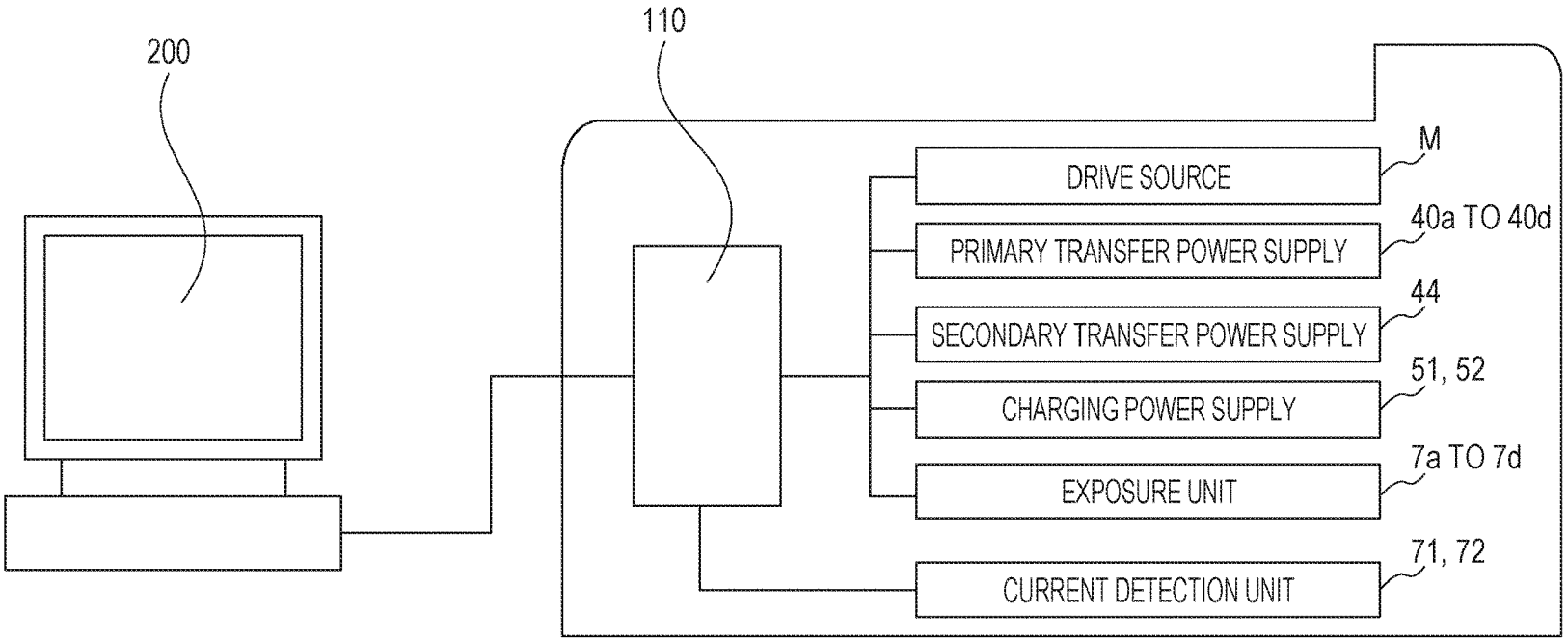
FIG. 2 is a block diagram related to the first embodiment.

FIG. 1 is a cross-sectional view schematically illustrating an image-forming apparatus 10 according to the present embodiment. FIG. 2 is a block diagram related to a control system of the image-forming apparatus 10 according to the present embodiment. As illustrated in FIG. 2, the image-forming apparatus 10 is connected to a personal computer 200, which serves as a host apparatus. The personal computer 200 transmits an instruction for starting operation and image signals to a controller 110, which serves as a control unit. While the controller 110 controls various units, the image-forming apparatus 10 performs image forming.

The image-forming apparatus 10 according to the present embodiment is a color image-forming apparatus that employs an electrophotographic process and an intermediate image transfer system. The image-forming apparatus 10 has a first image forming section 1*a*, a second image forming section 1*b*, a third image forming section 1*c*, and a fourth image forming section 1*d*, which serve as a plurality of image forming units. The first, second, third, and fourth image forming sections 1*a*, 1*b*, 1*c*, and 1*d* serve to form respective color images of yellow, magenta, cyan, and black. As illustrated in FIG. 1, the four image forming sections 1*a*, 1*b*, 1*c*, and 1*d* are arranged in a row with a constant spacing provided between adjacent image forming sections.

Note that in the present embodiment, the configurations of the first to fourth image forming sections 1*a* to 1*d* are substantially the same except for the colors of toners to be used. Accordingly, when it is not necessary to focus on differences, image forming sections 1 will be described collectively by omitting suffixes a, b, c, and d, which indicate that corresponding elements are provided for individual colors.

As illustrated in FIG. 1, image forming sections 1 include respective drum-type electrophotographic photoreceptors 2 (hereinafter referred to as "photosensitive drums 2"), each of which is rotatable in the direction of arrow R1 and serves as a first image bearing member on which a toner image is formed. A photosensitive drum 2 includes a drum-charging roller 3 serving as a unit for charging the photosensitive drum 2, a development unit 4, and a cleaning unit 6, which are disposed around the photosensitive drum 2. In addition, an exposure unit 7 (laser scanner) is disposed downstream of the drum-charging roller 3 and upstream of the development unit 4 with respect to the rotation direction of the photosensitive drum 2.

An intermediate transfer belt 20, which is an endless-belt-type intermediate transfer member, is disposed so as to oppose each of the photosensitive drums 2 of the image forming sections 1. The intermediate transfer belt 20 extends around a drive roller 21, an extension roller 22, and an opposing roller 23, which serve as a plurality of support members. The drive roller 21 that rotates in the direction of arrow R2 in FIG. 1 enables the intermediate transfer belt 20 to move in the direction of arrow R3. Note that the drive roller 21, the extension roller 22, and the opposing roller 23 are connected to ground.

Primary transfer rollers 5*a* to 5*d*, which serve as primary transfer members, are disposed along the inner peripheral surface of the intermediate transfer belt 20 so as to oppose the respective photosensitive drums 2 of the image forming sections 1. A secondary transfer roller 24, which serves as a secondary transfer member, is disposed on the outer peripheral surface of the intermediate transfer belt 20 so as to oppose the opposing roller 23.

Each photosensitive drum 2 according to the present embodiment is an organic photo-conductive (OPC) member with negative chargeability and has a photosensitive layer on an aluminum drum base. The photosensitive drum 2 is rotationally driven in the direction of arrow R1 (clockwise) in FIG. 1 by a driving device (not illustrated) at a predetermined circumferential velocity (surface-moving speed). In the present embodiment, the circumferential velocity of the photosensitive drum 2 corresponds to the processing speed of the image-forming apparatus 10.

Development units 4*a*, 4*b*, 4*c*, and 4*d* contain respective toners of yellow, magenta, cyan, and black. As illustrated in FIG. 1, in a full-color image forming mode, in other words, a first mode (hereinafter referred to as a "full-color mode"), four photosensitive drums 2 are in contact with the intermediate transfer belt 20, and respective development rollers 8 of the four development units 4 are in contact with the photosensitive drums 2. A monochrome image forming mode, in other words, a second mode (hereinafter referred to as a "monochrome mode"), will be described later.

In the present embodiment, an intermediate transfer belt formed of polyethylene naphthalate (PEN) resin was used as the intermediate transfer belt 20. The intermediate transfer belt 20 initially exhibited a surface resistivity of $5.0\times10^{11}$ Ω/sq. and a volume resistivity of $8.0\times10^{11}$ Ωcm.

Other resins including polyvinylidene difluoride (PVDF), ethylene-tetrafluoroethylene copolymer (ETFE), polyimide resin, polyethylene terephthalate (PET), and polycarbonate can be used for the intermediate transfer belt 20. Alternatively, the intermediate transfer belt 20 can be formed as an endless belt that has a rubber base layer made of, for example, ethylene-propylene-diene rubber (EPDM), and the surface of the rubber base layer is covered by urethane rubber in which a fluorocarbon polymer, such as polytetrafluoroethylene, is dispersed.

Each of the primary transfer rollers 5 can be formed of an elastic member, such as a foam rubber member. In the present embodiment, a nickel-plated steel bar having a diameter of 6 mm and being covered by nitrile rubber (NBR) and epichlorohydrin rubber to a thickness of 4 mm was used as the primary transfer roller 5. The primary transfer roller 5 exhibited an electric resistance of $1.0\times10^{5}$Ω when a voltage of 100 V was applied while the primary transfer roller 5 was pressed against an aluminum cylinder at a force of 9.8 N and rotated at a surface-moving speed of 50 mm/sec.

The primary transfer rollers 5 are disposed at positions opposing respective photosensitive drums 2 with the intermediate transfer belt 20 being interposed therebetween. The primary transfer rollers 5 press the intermediate transfer belt 20 against the photosensitive drums 2, thereby forming respective primary transfer portions N1. The primary transfer rollers 5 rotate passively in accordance with movement of the intermediate transfer belt 20. Primary transfer power supplies 40 are connected to the respective primary transfer rollers 5 and can apply a voltage having positive or negative polarity to the primary transfer rollers 5.

The secondary transfer roller 24 is formed of, for example, an elastic member, such as a foam rubber member. In the present embodiment, a nickel-plated steel bar having a diameter of 6 mm and being covered by nitrile rubber (NBR) and epichlorohydrin rubber to a thickness of 6 mm was used as the secondary transfer roller. The secondary transfer roller 24 exhibited an electric resistance of $3.0\times10^{7}$Ω when a voltage of 1000 V was applied while the secondary transfer roller was pressed against an aluminum cylinder at a force of 9.8 N and rotated at a surface-moving speed of 50 mm/sec.

The secondary transfer roller 24 is in contact with the intermediate transfer belt 20 at a position opposing the opposing roller 23 and thereby forms a secondary transfer portion N2. A secondary transfer power supply 44 is connected to the secondary transfer roller 24. The secondary transfer power supply 44 can apply a voltage having positive or negative polarity to the secondary transfer roller 24.

A charging unit 30 is disposed downstream of the secondary transfer portion N2 with respect to the movement direction of the intermediate transfer belt 20. The charging unit 30 charges residual toner on the intermediate transfer belt 20. A configuration and operation of the charging unit 30 will be described in detail later.

A registration roller 13, which serves as a conveyor unit for conveying a transfer medium P, is disposed upstream of the secondary transfer portion N2 with respect to the conveying direction of the transfer medium P. In addition, a fixing unit 12 is disposed downstream of the secondary transfer portion N2 with respect to the conveying direction of the transfer medium P. The fixing unit 12 has a fixing roller 12A equipped with a heat source and has a pressure roller 12B that presses against the fixing roller 12A at a predetermined pressure.

Image Forming Operation

Next, an image forming operation in the image-forming apparatus 10 will be described with reference to FIG. 1 by taking a full-color mode as an example.

When a signal for starting an image forming operation is issued, the photosensitive drums 2 are rotationally driven at a predetermined circumferential velocity in the direction of arrow R1 in FIG. 1. During the rotation, the photosensitive drums 2 are charged by the respective drum-charging rollers 3 so as to generate a uniform potential distribution on the surfaces of the drums. Each drum-charging roller 3, which is in contact with the corresponding photosensitive drum 2 at a predetermined contact pressure, charges the surface of the photosensitive drum 2 uniformly to a predetermined potential while a charging power supply (not illustrated) applies a predetermined voltage to the drum-charging roller 3. In the present embodiment, the drum-charging roller 3 charges the photosensitive drum 2 to a negative polarity.

The exposure unit 7 exposes the surface of the photosensitive drum 2 to light and thereby forms an electrostatic latent image corresponding to image information on the surface of the photosensitive drum 2 that has been charged by the drum-charging roller 3. More specifically, the exposure unit 7 outputs, from a laser output section, laser light modulated in accordance with a time-series electrical digital pixel signal of the image information that has been input from the personal computer 200. The surface of the photosensitive drum 2 is subsequently irradiated with the laser light via a reflecting mirror. Thus, the electrostatic latent image is formed on the surface of the photosensitive drum 2.

The development unit 4, which uses a contact development method, includes a development roller 8 serving as a developer bearing member that is in contact with the photosensitive drum 2. While the development roller 8 is rotationally driven by a drive unit (not illustrated), toner born by the development roller 8 in a thin layer is conveyed to a development region where the development roller 8 and the photosensitive drum 2 are in contact with each other. A development power supply (not illustrated) supplies a voltage to the development roller 8, which causes the electrostatic latent image formed on the photosensitive drum 2 to be developed into a toner image.

The electrostatic latent image formed on the photosensitive drum 2 is developed by using a reversal development method. In other words, toner charged with the same polarity as the charging polarity of the photosensitive drum 2 (i.e., negative polarity in the present embodiment) adheres to the portion of the photosensitive drum 2 that has been exposed to light by the exposure unit 7. Thus, the electrostatic latent image is developed into a toner image. The normal charging polarity of the toner accommodated in the development unit 4 is negative.

Note that a contact development method is used in the present embodiment. However, a non-contact development method may also be used. In addition, a reversal development method is used in developing the electrostatic latent image in the present embodiment. However, the invention can be applied to an image-forming apparatus that utilizes a positive development method for developing an electrostatic latent image by using toner charged with a polarity opposite to the charging polarity of the photosensitive drum 2.

The toner image developed on the photosensitive drum 2 is transferred (i.e., primary-transferred) from the photosensitive drum 2 onto the intermediate transfer belt 20 in the primary transfer portion N1 while the primary transfer power supply 40 applies a voltage having positive polarity, which is the polarity opposite to the normal charging polarity of toner, to a corresponding primary transfer roller 5. Thus, in each primary transfer portion N1, the toner image of each color is primary-transferred onto the intermediate transfer belt 20, and the toner images are overlaid on each other. Consequently, a multilayered toner image composed of the toner images of a plurality of colors is formed on the intermediate transfer belt 20.

The leading edge of the multicolor toner image that has been primary-transferred onto the intermediate transfer belt 20 reaches the secondary transfer portion N2. In synchronization with this timing, the registration roller 13 conveys a transfer medium P to the secondary transfer portion N2. In the secondary transfer portion N2, the entire multicolor toner image is transferred (i.e., secondary-transferred) from the intermediate transfer belt 20 onto the transfer medium P while the secondary transfer power supply 44 applies a voltage having positive polarity, which is opposite to the normal charging polarity of toner, to the secondary transfer roller 24.

Subsequently, the transfer medium P to which the multicolor toner image is secondary-transferred is conveyed to the fixing unit 12 and is heated and pressed by a fixing roller 12A and a pressure roller 12B. As a result, the multicolor toners are fused and blended, and fixed on the transfer medium P. The transfer medium P on which the multicolor toner image has been fixed is discharged from the image-forming apparatus 10. Thus, a series of image forming operations is completed.

The residual toner remaining on the photosensitive drum 2 after the primary transfer is removed therefrom by a cleaning blade 61 that serves as a contact member formed of an elastic material such as urethane rubber. The residual toner is subsequently collected in the cleaning unit 6 that serves as a collection unit for collecting the toner.

The toner that is not secondary-transferred to the transfer medium P and remains on the intermediate transfer belt 20 (hereinafter referred to as "residual toner") is moved by the intermediate transfer belt 20 and is subsequently charged by the charging unit 30. The residual toner is moved further by the intermediate transfer belt 20 to a primary transfer portion N1. When the residual toner passes the primary transfer portion N1, the potential difference between the intermediate transfer belt 20 and the photosensitive drum 2 causes the residual toner to be electrostatically transferred from the intermediate transfer belt 20 to the photosensitive drum 2. Thus, the residual toner is collected by the cleaning unit 6.

Collection Operation for Residual Toner

Figure 3:
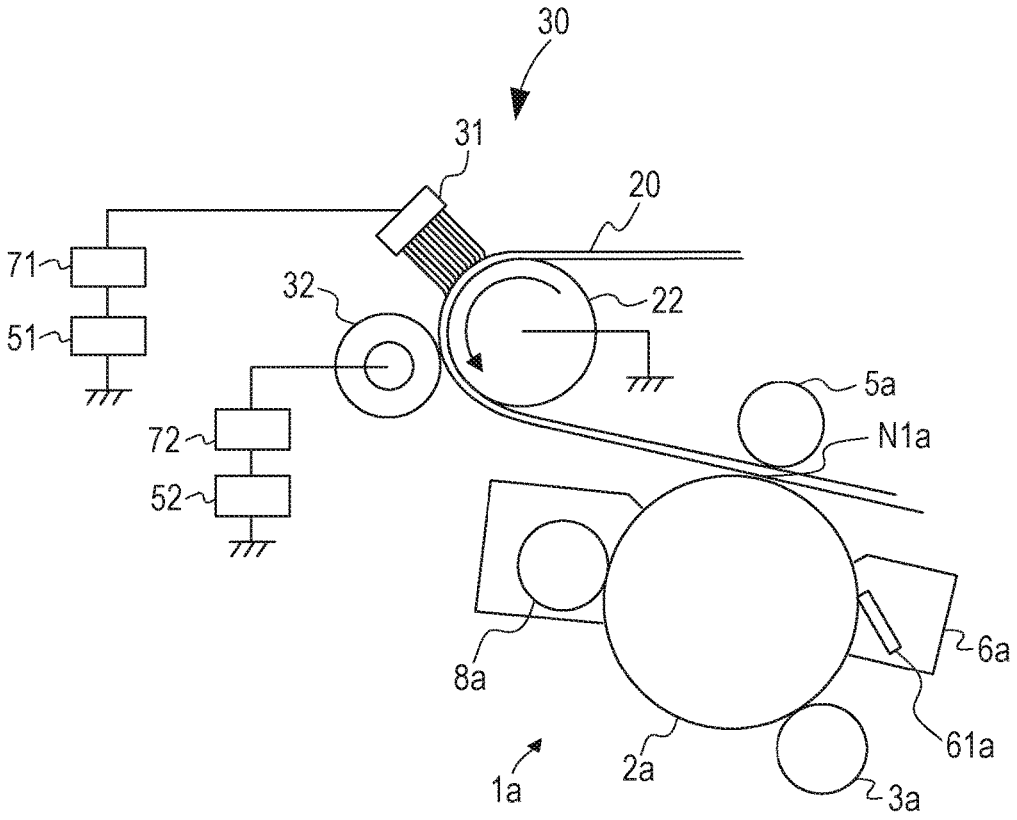
FIG. 3 is a diagram illustrating an example configuration of a charging unit according to the first embodiment.

A collection operation to collect residual toner in the present embodiment will be described in detail with reference to FIG. 3. FIG. 3 is a diagram illustrating a configuration of the charging unit 30 according to the present embodiment.

As illustrated in FIG. 3, the charging unit 30 has a conductive brush 31 and a conductive roller 32. The conductive brush 31 and the conductive roller 32 are disposed downstream of the secondary transfer portion N2 and upstream of a primary transfer portion N1*a* with respect to the movement direction of the intermediate transfer belt 20. In addition, the conductive roller 32 is disposed between the conductive brush 31 and the primary transfer portion N1*a*. Both the conductive brush 31 and the conductive roller 32 are in contact with the intermediate transfer belt 20.

The conductive brush 31 is a brush member that has a brush width of 5 mm and is made of nylon fibers to which electroconductivity is imparted. The fineness of nylon fibers is 7 dtex, and the pile length is 5 mm. The conductive brush 31 exhibits an electric resistance of $1.0\times10^{6}\Omega$ when a voltage of 500 V is applied while the conductive brush 31 is pressed against an aluminum cylinder at a force of 9.8 N and rotated at a surface-moving speed of 50 mm/sec.

The conductive roller 32 (i.e., roller member) is formed of a nickel-plated steel bar having a diameter of 6 mm and covered, to a thickness of 5 mm, by a solid elastic member made of EPDM with carbon being dispersed therein. The conductive roller 32 exhibits an electric resistance of $5.0\times10^{7}\Omega$ when a voltage of 500 V is applied while the conductive roller 32 is pressed against an aluminum cylinder at a force of 9.8 N and rotated at a surface-moving speed of 50 mm/sec. The conductive roller 32 is pressed at a total pressure of 9.8 N against the extension roller 22 with the intermediate transfer belt 20 interposed therebetween.

As illustrated in FIG. 3, the conductive brush 31 is electrically connected to a charging power supply 51 via a current detection unit 71. The charging power supply 51 is able to apply a voltage having positive or negative polarity to the conductive brush 31. Similarly, the conductive roller 32 is electrically connected to a charging power supply 52 via a current detection unit 72. The charging power supply 52 is able to apply a voltage having positive or negative polarity to the conductive roller 32.

When performing the collection operation for residual toner, the conductive brush 31 and the conductive roller 32 are charged with voltages of positive polarity by the charging power supplies 51 and 52, respectively. Output voltages from the charging power supplies 51 and 52 are controlled by the controller 110, which serves as a control unit, in such a manner that respective current values detected by the current detection units 71 and 72 become equal to preset target current values (i.e., constant current control). The target current values are set appropriately in accordance with the design requirements and operational environment of the image-forming apparatus 10 so as to not charge residual toner excessively and not cause faulty cleaning due to insufficient charging of the residual toner. In the present embodiment, the target current value for the conductive brush 31 was set at 20 μA, and the target current value for the conductive roller 32 was set at 30 μA.

Collection Operation for Residual Toner in Full-color Mode

In the full-color mode, images are formed while the photosensitive drums 2*a* to 2*d* are in contact with the intermediate transfer belt 20 (i.e., a first state). When collecting residual toner in the full-color mode, the charging unit 30 charges the residual toner remaining on the intermediate transfer belt 20 to positive polarity. At this moment, the charging power supply 51 applies a voltage having positive polarity to the conductive brush 31, which causes a portion of the residual toner having been charged in negative polarity to adhere electrostatically to the conductive brush 31. This can reduce the amount of the residual toner that passes, during collection, the region where the conductive roller 32 and the intermediate transfer belt 20 are in contact with each other.

With the movement of the intermediate transfer belt 20, the residual toner having been charged with positive polarity by the charging unit 30 reaches the primary transfer portion N1*a* of an image forming section 1*a* that is located upstream of any other image forming sections. Here, a voltage having positive polarity applied to a primary transfer roller 5*a* causes the residual toner having been charged with positive polarity to move electrostatically from the intermediate transfer belt 20 to a photosensitive drum 2*a*. The residual toner that has been moved to the photosensitive drum 2*a* is moved further with the rotation of the photosensitive drum 2*a*. Consequently, the residual toner is collected in a cleaning unit 6*a* by using a cleaning blade 61*a*.

The collection operation for residual toner is thus performed in the full-color mode. Note that in the present embodiment, it is described that the photosensitive drum 2*a* collects residual toner, wherein the photosensitive drum 2*a* is disposed upstream of any other photosensitive drums with respect to the movement direction of the intermediate transfer belt 20. However, photosensitive drums other than the photosensitive drum 2*a* may collect residual toner by controlling the direction of an electric field formed in each of the primary transfer portions N1. For example, the direction of the electric field formed in each of the primary transfer portions N1 can be controlled by controlling the polarity and the voltage of a corresponding drum-charging roller 3 and exposure unit 7 and by controlling the polarity and the voltage of a corresponding primary transfer roller 5 that is applied by a primary transfer power supply 40.

Collection Operation for Residual Toner in Monochrome Mode

Figure 4:
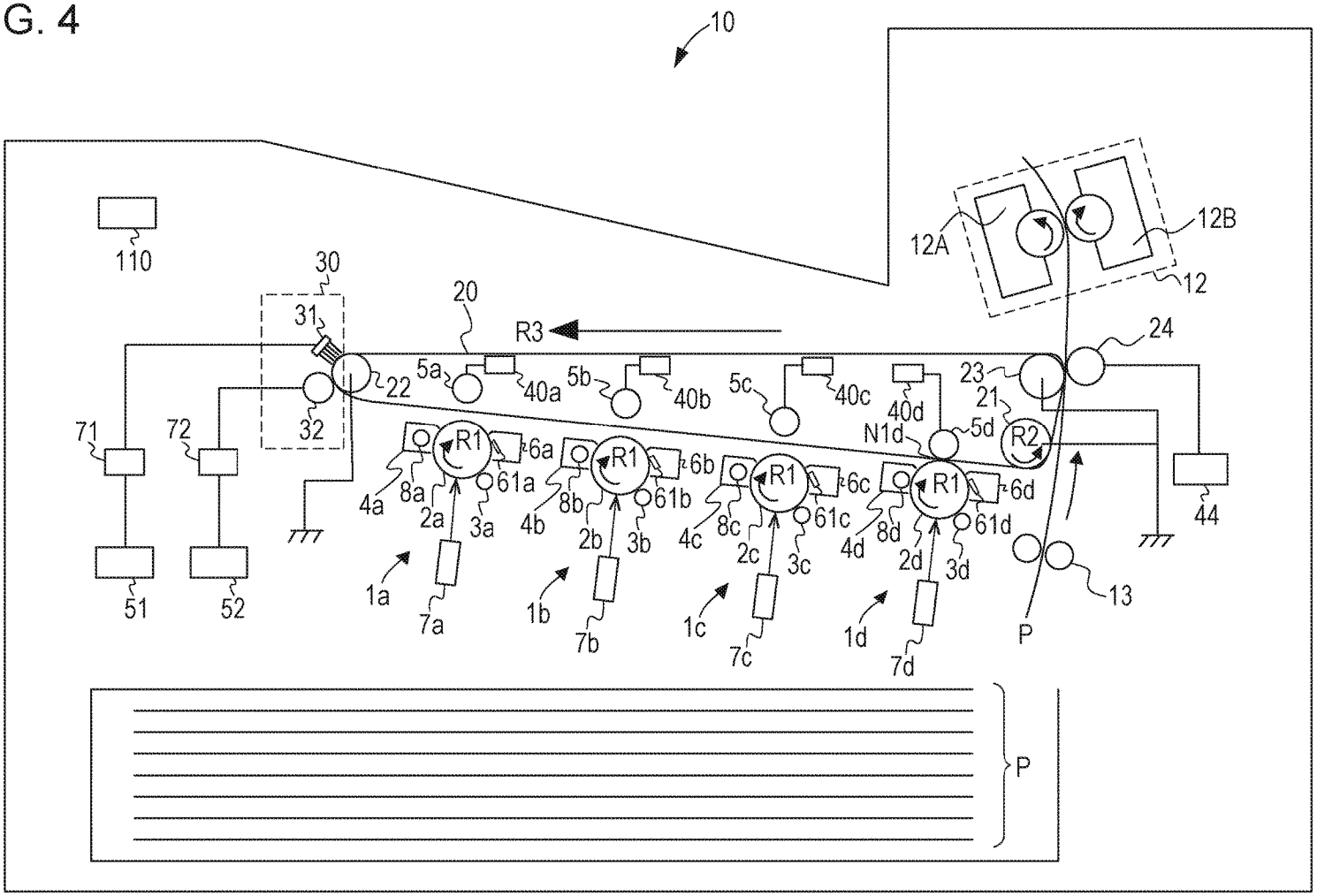
FIG. 4 is a diagram illustrating a state of contact or separation between image bearing members and an intermediate transfer member when executing a monochrome mode in the first embodiment.

FIG. 4 is a diagram illustrating a contact state between each of the photosensitive drums 2 and the intermediate transfer belt 20 when executing a monochrome mode in the present embodiment. In the monochrome mode, as illustrated in FIG. 4, a photosensitive drum 2*d* is brought into contact with the intermediate transfer belt 20, while other photosensitive drums 2*a* to 2*c* are separated from the intermediate transfer belt 20 (i.e., a second state). In this state, images are formed by using only an image forming section 1*d* having a development unit 4*d* that accommodates a black toner. In this case, the development rollers 8*a* to 8*c* of image forming sections 1*a* to 1*c*, which are not involved in image forming, are separated from respective photosensitive drums 2*a* to 2*c*. In the image forming sections 1*a* to 1*c* that are not involved in image forming, the isolation of the photosensitive drums 2*a* to 2*c* and the development rollers 8*a* to 8*c* can reduce the deterioration and wear of these members caused by contact rotation and voltage application.

A mechanism to bring a photosensitive drum 2 into contact with the intermediate transfer belt 20, or to separate the photosensitive drum 2 therefrom, may be realized, for example, by using an urging unit, such as a spring, that presses the corresponding primary transfer roller 5 toward the photosensitive drum 2 with the intermediate transfer belt 20 interposed therebetween. In this configuration, the primary transfer roller 5 and the intermediate transfer belt 20 can be separated from the photosensitive drum 2 by releasing the spring from the urged state.

When performing a collection operation for residual toner in the monochrome mode, residual toner is first charged with positive polarity by the charging unit 30 as is the case for the collection operation in the full-color mode. With the movement of the intermediate transfer belt 20, the residual toner subsequently passes the positions where the image forming sections 1*a* to 1*c* oppose the intermediate transfer belt 20. At these positions, the primary transfer portions N1*a* to N1*c* have ceased to exist due to the operation of separation mechanisms (not illustrated). The residual toner reaches a primary transfer portion N1*d*.

Here, a primary transfer power supply 40*d* applies a voltage having positive polarity to a primary transfer roller 5*d*, which causes the residual toner having been charged with positive polarity to move electrostatically from the intermediate transfer belt 20 to the photosensitive drum 2*d*. The residual toner that has moved to the photosensitive drum 2*d* further moves with the rotation of the photosensitive drum 2*d*. Consequently, the residual toner is collected in a cleaning unit 6*d* by using a cleaning blade 61*d*. The collection operation for residual toner is thus performed in the monochrome mode.

Collection Operation for Residual Toner in Comparative Example

This section describes control of the collection operation for residual toner in a comparative example comparable to the present embodiment and results of an image output experiment. The image output experiment was conducted by using a sheet passing test for validating durability of components in which transfer media P were continuously passed through an image-forming apparatus (hereinafter referred to as a "sheet passing durability test"). Image quality was subsequently evaluated for the full-color mode and for the monochrome mode every time a predetermined number of transfer media P were passed. The procedure of the sheet passing durability test and the details of the image quality evaluation will be described below.

The sheet passing durability test was conducted at a temperature of 15° C. and at a relative humidity of 10% by repeating the process in which an image was formed contiguously on two sheets of transfer medium P. The image that was formed included cyan, magenta, yellow, and black images, and the image ratio of each of these color images was 25%. For the transfer media P, sheets of paper GFC-081 (available from Canon Marketing Japan) were used. The image forming mode was a plain paper mode. The processing speed of the image-forming apparatus 10 was 180 mm per second, and the throughput was 30 sheets per minute.

Image quality evaluation was conducted under the same environmental conditions as in the sheet passing durability test. In the image quality evaluation, evaluation images were formed at the start and per 50000 sheets passed in the sheet passing durability test. Evaluation images for the full-color mode were images of primary colors including cyan, magenta, yellow, and black and of secondary colors including red, blue, and green. The evaluation images were formed on respective transfer media P, for which GFC-081 (available from Canon Marketing Japan) was used. More specifically, a set of evaluation images, including a maximum density image (i.e., solid image), an image having an image ratio of 50% (i.e., halftone image), and an image having characters and thin lines, were formed three times per each of the colors listed above. Accordingly, a total of 63 sheets were output.

Evaluation images for the monochrome mode were a set of images including a maximum density image (i.e., solid image), an image having an image ratio of 50% (i.e., halftone image), and an image having characters and thin lines. Twenty-one sets of the evaluation images were formed by using the black color on the same type of transfer media P as used in the full-color mode. Accordingly, a total of 63 sheets were output.

The evaluation images that had been formed in such a manner were evaluated for whether or not image defects due to faulty cleaning were present. More specifically, the evaluation images formed in such a manner were observed to determine whether or not a residual image remaining on the intermediate transfer belt 20 from the previous secondary transfer occurs during the current secondary transfer. The following symbols and evaluation criteria were used. A: faulty cleaning did not occur; B: a minor image defect was observed; and C: faulty cleaning occurred.

TABLE 1

| The number of sheets passed | Output voltage of primary transfer power supply 40 a | b | c | d | Conductive brush 31 Target current value | Conductive roller 32 Target current value | Image quality evaluation 10 p | 20 p | 30 p | 40 p | 50 p | 63 p |
|---|---|---|---|---|---|---|---|---|---|---|---|---|
| 0 | | 1400 V | | | 20 μA | 30 μA | A | A | A | A | A | A |
| 50000 | | 1600 V | | | 20 μA | 30 μA | A | A | A | A | A | A |
| 100000 | | 1800 V | | | 20 μA | 30 μA | A | A | A | A | A | A |
| 150000 | | 2000 V | | | 20 μA | 30 μA | A | A | A | A | A | A |

Table 1 shows results of the image quality evaluation conducted per 50000 sheets that were passed in the sheet passing durability test in the full-color mode of the comparative example. The evaluation results are collated in Table 1 per 10 sheets in the image quality evaluation. Table 1 also shows the output voltage of the primary transfer power supplies 40, the target current value of the conductive brush 31, and the target current value of the conductive roller 32 when the image quality evaluation was conducted. The target current values of the conductive brush 31 and the conductive roller 32 are measured results detected by the current detection unit 71 and the current detection unit 72, respectively. In the comparative example in the full-color mode, as illustrated in Table 1, the initial output voltage (i.e., first voltage) of the primary transfer power supplies 40 is 1400 V. The target current value of the conductive brush 31 is 20 μA, and the target current value of the conductive roller 32 is 30 μA.

The electric resistance of the primary transfer rollers 5 and the intermediate transfer belt 20 tends to increase as the number of transfer media P passed increases. Accordingly, if the primary transfer power supplies 40 continue to output the same voltage as the initial voltage during the sheet passing durability test, the potential difference between each of the photosensitive drums 2 and the intermediate transfer belt 20 in the corresponding primary transfer portion N1 decreases as the number of sheets passed increases, resulting in changes in primary transfer performance. For this reason, in order to maintain uniform primary transfer performance, the sheet passing durability test is conducted by increasing the output voltage applied by the primary transfer power supplies 40 as the number of sheets passed increases, as indicated in Table 1.

As the results in Table 1 indicate, in the full-color mode of the comparative example, the evaluation images did not exhibit image defects, and accordingly, faulty cleaning did not occur after 150000 sheets were passed in the comparative example.

Table 2 shows results of the image quality evaluation conducted per 50000 sheets that were passed in the sheet passing durability test in the monochrome mode of the comparative example. The evaluation results are collated in Table 2 per 10 sheets in the image quality evaluation. Table 2 also shows the output voltage of the primary transfer power supply 40*d*, the target current value of the conductive brush 31, and the target current value of the conductive roller 32 when the image quality evaluation was conducted. As indicated in Table 2, the output voltage of the primary transfer power supply 40*d* and the target current values of the conductive brush 31 and the conductive roller 32 were set at the same levels as those in the full-color mode. Note that in the monochrome mode, the primary transfer power supplies 40*a* to 40*c* do not output voltages since images are formed by using only the image forming section 1*d*.

As the results in Table 2 indicate, evaluation images started to exhibit image defects due to faulty cleaning from the point at which 100000 sheets were passed in the comparative example in the monochrome mode.

In the full-color mode, a plurality of photosensitive drums 2 is in contact with the intermediate transfer belt 20. In this case, even if the photosensitive drum 2*a* located upstream with respect to the movement direction of the intermediate transfer belt 20 does not fully collect residual toner, downstream photosensitive drums 2*b* to 2*d* can collect the residual toner. In contrast, in the monochrome mode, only the photosensitive drum 2*d* is in contact with the intermediate transfer belt 20. In this case, if residual toner passes the primary transfer portion N1*d*, no other members collect the residual toner downstream. Thus, faulty cleaning occurs.

In addition, in the monochrome mode, image defects due to faulty cleaning may occur more often than in the full-color mode as the number of sheets passed increases for the reasons described below.

Figure 5:
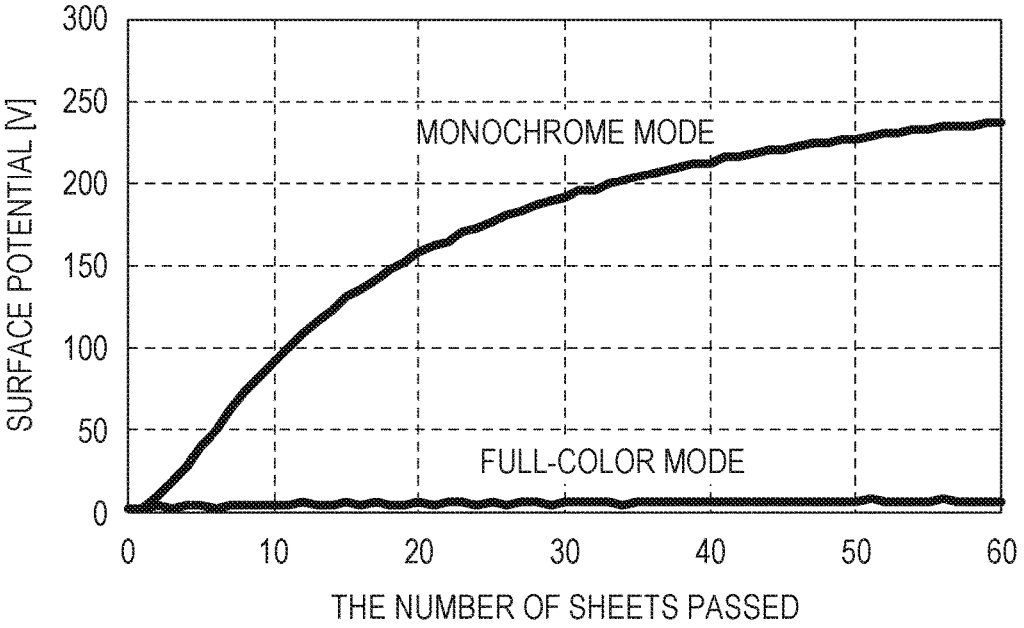
FIG. 5 is a graph showing measurement results of surface potential of an intermediate transfer member plotted as a function of the number of transfer media after 150000 sheets have been passed through an image-forming apparatus according to Comparative Example.

FIG. 5 is a graph showing measurement results of the surface potential of the intermediate transfer belt 20 plotted as a function of the number of transfer media P onto which evaluation images are formed during image quality evaluation after 150000 sheets have been passed in the sheet passing durability test. The surface potential of the intermediate transfer belt 20 was measured by using an electrostatic

TABLE 2

| The number of sheets passed | Output voltage of primary transfer power supply 40 a | b | c | d | Conductive brush 31 Target current value | Conductive roller 32 Target current value | Image quality evaluation 10 p | 20 p | 30 p | 40 p | 50 p | 63 p |
|---|---|---|---|---|---|---|---|---|---|---|---|---|
| 0 | — | — | — | 1400 V | 20 μA | 30 μA | A | A | A | A | A | A |
| 50000 | — | — | — | 1600 V | 20 μA | 30 μA | A | A | A | A | A | A |
| 100000 | — | — | — | 1800 V | 20 μA | 30 μA | A | A | A | A | B | C |
| 150000 | — | — | — | 2000 V | 20 μA | 30 μA | A | A | B | C | C | C |

volt meter (MODEL 344, available from Trek Japan) while passing transfer media P on which evaluation images are formed. More specifically, a noncontacting electrostatic probe (MODEL 555P-4, available from Trek Japan) was disposed at a position 10 mm above the extension roller 22, and the signal from the probe was output on the electrostatic volt meter.

FIG. 5 shows that in the full-color mode, the increase of the surface potential of the intermediate transfer belt 20 is suppressed, whereas in the monochrome mode, the surface potential of the intermediate transfer belt 20 increases to approximately 240 V after 60 sheets are passed. This indicates that in the full-color mode, while the surface potential of the intermediate transfer belt 20 increases when the charging unit 30 charges residual toner with positive polarity, the increase of the surface potential is alleviated when the intermediate transfer belt 20 passes the primary transfer portions N1.

Figure 6:
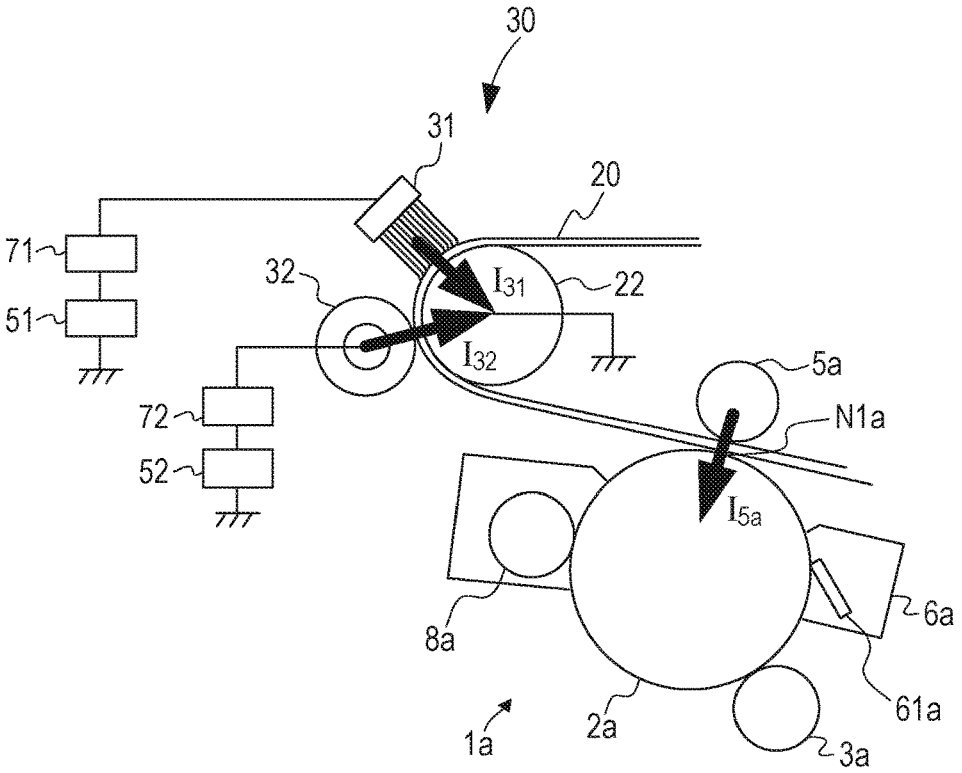
FIG. 6 is a diagram illustrating electric current flow paths from the charging unit and a primary transfer member to the intermediate transfer member in a full-color mode in the first embodiment.

FIG. 6 is a diagram illustrating electric current flow paths from the charging unit 30 and a primary transfer roller 5 to the intermediate transfer belt 20 in the full-color mode. As illustrated in FIG. 6, the charging unit 30 is charged with a voltage having positive polarity by the charging power supplies 51 and 52, an electric current $I_{31}$ and an electric current $I_{32}$ flows from the outer peripheral surface of the intermediate transfer belt 20 toward the inner peripheral surface thereof in a region where the charging unit 30 is in contact with the intermediate transfer belt 20. On the other hand, in the primary transfer portion N1*a*, an electric current $I_{5a}$ flows from the inner peripheral surface of the intermediate transfer belt 20 toward the outer peripheral surface thereof since the primary transfer power supply 40*a* charges the primary transfer roller 5*a* with a voltage having positive polarity and the photosensitive drum 2*a* is charged with negative polarity.

In the full-color mode, electric currents equivalent to the electric current $I_{5a}$ of the image forming section 1*a* also flow in the other image forming sections 1*b* to 1*d*. In other words, the charging unit 30 being in contact with the outer peripheral surface of the intermediate transfer belt 20 and the primary transfer rollers 5 being in contact with the inner peripheral surface of the intermediate transfer belt 20 are disposed so as to alleviate the surface potential accumulated on the intermediate transfer belt 20.

In the monochrome mode, the photosensitive drum 2*d* and the primary transfer roller 5*d* come into contact with the intermediate transfer belt 20 and thereby form the primary transfer portion N1*d*, while the primary transfer portions N1*a* to N1*c* are not formed in the other image forming sections 1*a* to 1*c*. Accordingly, the increase of the surface potential of the intermediate transfer belt 20 caused by the charging of the charging unit 30 is not readily suppressed compared with the configuration of the full-color mode. As a result, every time the intermediate transfer belt 20 rotates around, the surface potential increases. Consequently, the potential difference required for moving residual toner from the intermediate transfer belt 20 to the photosensitive drum 2*d* becomes insufficient in the primary transfer portion N1*d*, which causes faulty cleaning.

The faulty cleaning tends to occur for this reason especially after the number of the transfer media P passed through the secondary transfer portion exceeds a predetermined number of sheets (i.e., later stage of durability), in other words, especially in the state in which the electric resistance of the intermediate transfer belt 20 has increased due to conduction degradation. This is because accumulated electric charges in the intermediate transfer belt 20 becomes more difficult to remove in a later stage of durability.

Collection Operation for Residual Toner in Present Embodiment

Next, a collection operation to collect residual toner in the monochrome mode of the present embodiment will be described with reference to Table 3 and FIG. 7. Operation and control to collect residual toner in the full-color mode in the present embodiment are the same as those described in the comparative example, and thus the description will not be repeated.

TABLE 3

| The number of | Output voltage of primary transfer power supply 40 | | | | Conductive brush 31 Target current | Conductive roller 32 Target current | Image quality evaluation | | | | | |
|---|---|---|---|---|---|---|---|---|---|---|---|---|
| sheets passed | a | b | c | d | value | value | 10 p | 20 p | 30 p | 40 p | 50 p | 63 p |
| 0 | — | — | — | 2100 V | 20 μA | 30 μA | A | A | A | A | A | A |
| 50000 | — | — | — | 2300 V | 20 μA | 30 μA | A | A | A | A | A | A |
| 100000 | — | — | — | 2500 V | 20 μA | 30 μA | A | A | A | A | A | A |
| 150000 | — | — | — | 2700 V | 20 μA | 30 μA | A | A | A | A | A | A |

Table 3 shows results of the image quality evaluation conducted per 50000 sheets that were passed in the sheet passing durability test in the monochrome mode of the present embodiment. The evaluation results are collated in Table 3 per 10 sheets in the image quality evaluation. Table 3 also shows the output voltage of the primary transfer power supply 40*d*, the target current value of the conductive brush 31, and the target current value of the conductive roller 32 when the image quality evaluation was conducted. In the present embodiment, as indicated in Table 3, the output voltage of the primary transfer power supply 40*d* in the monochrome mode (i.e., second voltage) was set higher than the output voltage of the primary transfer power supplies 40 used in the full-color mode (i.e., first voltage). Specifically, the output voltage in the monochrome mode was 700 V higher than the output voltage used for full-color mode. As a result, image defects due to the faulty cleaning were not observed in the configuration of the present embodiment. The target current values for the conductive brush 31 and the conductive roller 32 were set at the same levels as those used in the full-color mode.

In general, the higher the absolute value of the second voltage with respect to the first voltage, the more readily the increase of the surface potential of the intermediate transfer belt 20 is alleviated. However, if the absolute value is excessively high, the potential difference becomes excessively large in the primary transfer portion N1*d*, which may cause abnormal discharge and lead to unevenness in potential on the surface of the photosensitive drum 2*d* after the photosensitive drum 2*d* passes the primary transfer portion N1*d*. The photosensitive drum 2*d* continues to rotate and the drum-charging roller 3 charges the photosensitive drum 2*d*. In the case of the drum-charging roller 3 not eliminating the unevenness in surface potential, development performance is disturbed, resulting in an image defect such as density unevenness in an image.

Accordingly, the second voltage is desirably set in a value range in which abnormal discharge does not occur in the primary transfer portion N1*d*. The range of voltage to be set is appropriately determined in accordance with the impedance of the primary transfer portion N1*d*, which mainly involves the electric resistance of the intermediate transfer belt 20 and the electric resistance of the primary transfer roller 5*d*. In the configuration according to the present embodiment, if the difference between the absolute value of the second voltage and the absolute value of the first voltage is less than 1500 V, the occurrence of image defects due to the abnormal discharge can be suppressed. However, in order to further suppress the occurrence of abnormal discharge in the primary transfer portion N1*d* in the configuration of the present embodiment, the difference between the absolute value of the first voltage and the absolute value of the second voltage is more desirably set at less than 800 V.

If the absolute value of the second voltage is higher than the absolute value of the first voltage, the increase of the surface potential of the intermediate transfer belt 20 can be alleviated. However, if the difference between the absolute value of the first voltage and the absolute value of the second voltage is too small, the increase of the surface potential of the intermediate transfer belt 20 may not be alleviated sufficiently depending on the impedance of the primary transfer portion N1*d* and on the configuration of the image-forming apparatus. With the configuration of the image-forming apparatus according to the present embodiment, the second voltage is desirably set such that the difference between the absolute value of the first voltage and the absolute value of the second voltage is 30 V or more.

In the present embodiment, the voltage of the primary transfer power supplies 40 are controlled on the basis of constant voltage control. However, the voltage may be controlled on the basis of constant current control. When the constant current control is adopted, the target current value of the monochrome mode is set higher than that of the full-color mode. In this case, in the configuration of the image-forming apparatus according to the present embodiment, the target current value of the monochrome mode is preferably set such that the output voltage is less than the sum of the voltage of the full-color mode and 1500 V. In addition, in the configuration of the image-forming apparatus according to the present embodiment, the target current value of the monochrome mode is preferably set such that the output voltage is equal to or more than the sum of the voltage of the full-color mode and 30 V.

Figure 7:
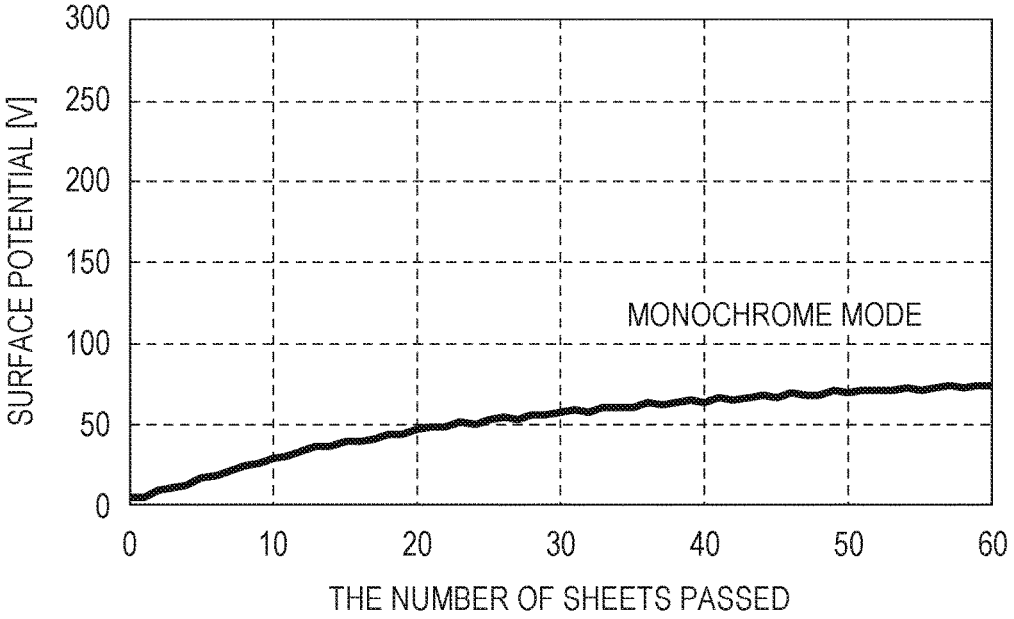
FIG. 7 is a graph showing measurement results of surface potential of the intermediate transfer member plotted as a function of the number of transfer media after 150000 sheets have been passed through the image-forming apparatus according to the first embodiment in a monochrome mode.

FIG. 7 is a graph showing measurement results of the surface potential of the intermediate transfer belt 20 plotted as a function of the number of transfer media P onto which evaluation images are formed during image quality evaluation conducted after 150000 sheets have been passed in the sheet passing durability test in the monochrome mode. In the measurement results of the comparative example, as indicated in FIG. 5, the surface potential of the intermediate transfer belt 20 increases to approximately 240 V, whereas in the present embodiment, as indicated in FIG. 7, the increase of the surface potential is suppressed to approximately 70 V. This is because the increase of the voltage applied by the primary transfer power supply 40*d* to the primary transfer roller 5*d* alleviates the surface potential of the intermediate transfer belt 20 that is generated by charging of the charging unit 30. As indicated in FIG. 7, the surface potential of the intermediate transfer belt 20 becomes substantially saturated when 60 sheets of transfer media P are passed.

In summary, according to the present embodiment, the occurrence of the faulty cleaning can be suppressed in the monochrome mode by increasing the voltage applied to the primary transfer roller 5 relative to the voltage in the full-color mode.

It has been described that in the present embodiment, when carrying out the residual toner collection operation in the monochrome mode, the voltage applied to the primary transfer roller 5 is increased relative to the voltage in the full-color mode regardless of the number of sheets passed. However, the residual toner collection operation is not limited to this. In the monochrome mode, the voltage applied to the primary transfer roller 5 may be increased relative to that in the full-color mode in a later stage of durability in which the number of transfer media P onto which toner images are transferred in the secondary transfer portion N2 exceeds a predetermined number of sheets and the electric resistance of the intermediate transfer belt 20 has increased.

As a method of suppressing the faulty cleaning in the monochrome mode without separating the photosensitive drums 2*a* to 2*c* from the intermediate transfer belt 20, the primary transfer power supplies 40*a* to 40*c* may apply a voltage having positive polarity to the primary transfer rollers 5*a* to 5*c*. However, with this configuration, wear of the image forming sections 1*a* to 1*c* that are not involved in image forming may be accelerated, which leads to a negative impact on the service life of the image-forming apparatus 10. Moreover, with this configuration, residual toner is moved to the photosensitive drum 2*a*, instead of the photosensitive drum 2*d*, and collected by the cleaning unit 6*a*, which makes it difficult to distribute the residual toner among other cleaning units. As a result, the size of the cleaning unit 6*a* may increase so as to provide capacity to accommodate the residual toner.

In the present embodiment, the output voltages of the primary transfer power supplies 40 in the full-color mode are set as a common voltage in the image forming sections 1*a* to 1*d*. However, the output voltages may be set differently for each of the image forming sections 1*a* to 1*d*. In this case, the voltage applied to the primary transfer roller 5*d* in the monochrome mode (i.e., the second voltage) may be set as follows. The absolute value of the second voltage may be set larger than any of the voltages that are applied to the primary transfer rollers 5*a* to 5*d* so as to move residual toner to any of the photosensitive drums 2*a* to 2*d* in the full-color mode (i.e., the first voltage). For example, if a voltage of 1400 V is applied to the primary transfer roller 5*a* for the photosensitive drum 2*a* to collect residual toner in the full-color mode, a voltage higher than 1400 V in absolute value is applied to the primary transfer roller 5*d* in the monochrome mode.

In the present embodiment, the configuration in which two members such as the conductive brush 31 and the conductive roller 32 are used as the cleaning unit 30 for cleaning residual toner has been described. However, a charging unit having a single member may be used to charge residual toner, or alternatively, a charging unit having three or more members may be used. The charging unit is not limited to a contact type, such as the charging unit 30. A non-contact type charging unit may be used.

Moreover, in the present embodiment, the primary transfer roller 5 having an elastic member, such as a foam rubber member, is used as a primary transfer member. However, a transfer brush, a transfer sheet, a metal roller, or the like, may be used as the primary transfer member. In addition, the primary transfer member may be disposed so as to deviate upstream or downstream of the corresponding primary transfer portion N1 with respect to the movement direction of the intermediate transfer belt 20.

In the present embodiment, in each of the image forming sections 1, the collection operation for residual toner may be performed simultaneously with the image forming operation or may be performed during a post-rotation operation after the image forming operation is completed. In the primary transfer, a photosensitive drum 2 transfers a negatively charged toner image to the intermediate transfer belt 20. In this process, positively charged residual toner can move from the intermediate transfer belt 20 to the photosensitive drum 2 by applying a voltage having positive polarity from a primary transfer power supply 40 to the corresponding primary transfer roller 5.

In the present embodiment, four primary transfer power supplies 40*a* to 40*d* are connected to four respective primary transfer rollers 5*a* to 5*d*. However, some of the primary transfer power supplies may be a common power supply. For example, the primary transfer rollers 5*a* to 5*c* may be connected to a common primary transfer power supply, and the primary transfer roller 5*d* may be connected to a separate primary transfer power supply. Reducing the number of the primary transfer power supplies 40, which serve as charging power supplies, leads to a reduction in cost and size of the image-forming apparatus 10.

Second Embodiment

In the first embodiment, it is described that the output voltage of a primary transfer power supply 40 in the monochrome mode (second mode) is changed with respect to the output voltage of the primary transfer power supplies 40 in the full-color mode (first mode). In the second embodiment, the target current value of the charging unit 30 is changed while increasing the output voltage of the primary transfer power supplies 40. Note that in the second embodiment, components common to those described in the first embodiment are denoted by the same numerals, and duplicated description will be omitted.

TABLE 4

| The number of sheets passed | Output voltage of primary transfer power supply 40 a | b | c | d | Conductive brush 31 Target current value | Conductive roller 32 Target current value | Image quality evaluation 10 p | 20 p | 30 p | 40 p | 50 p | 63 p |
|---|---|---|---|---|---|---|---|---|---|---|---|---|
| 0 | 1400 V | | | | 20 μA | 30 μA | A | A | A | A | A | A |
| 50000 | 1600 V | | | | 20 μA | 30 μA | A | A | A | A | A | A |
| 100000 | 1800 V | | | | 20 μA | 30 μA | A | A | A | A | A | A |
| 150000 | 2000 V | | | | 20 μA | 30 μA | A | A | A | A | A | A |
| 200000 | 2200 V | | | | 20 μA | 30 μA | A | A | A | A | A | A |

Table 4 shows results of the image quality evaluation conducted when up to 200000 sheets were passed in the sheet passing durability test in the full-color mode of the present embodiment. The evaluation results are collated in Table 4 per 10 sheets in the image quality evaluation. Table 4 also shows the output voltage of the primary transfer power supplies 40, the target current value of the conductive brush 31, and the target current value of the conductive roller 32. As indicated in Table 4, in the full-color mode, the faulty cleaning did not occur even when 200000 sheets were passed in the sheet passing durability test.

Table 5 shows results of the image quality evaluation when 200000 sheets were passed in the sheet passing durability test in the monochrome mode while the output voltage applied by the primary transfer power supply 40*d* to the primary transfer roller 5*d* was increased with respect to the output voltage applied in the full-color mode. Here, the output voltage of the primary transfer power supply 40*d* (i.e., second voltage) was set 700 V higher than the output voltage of the primary transfer power supplies 40 used in the full-color mode (i.e., first voltage). The target current values for the conductive brush 31 and the conductive roller 32 in the monochrome mode were set at the same levels as those used in the full-color mode.

As indicated in Table 5, the same results as in the first embodiment were obtained up to 150000 sheets passed. However, the occurrence of faulty cleaning was detected in the image quality evaluation after 200000 sheets passed.

Figure 8:
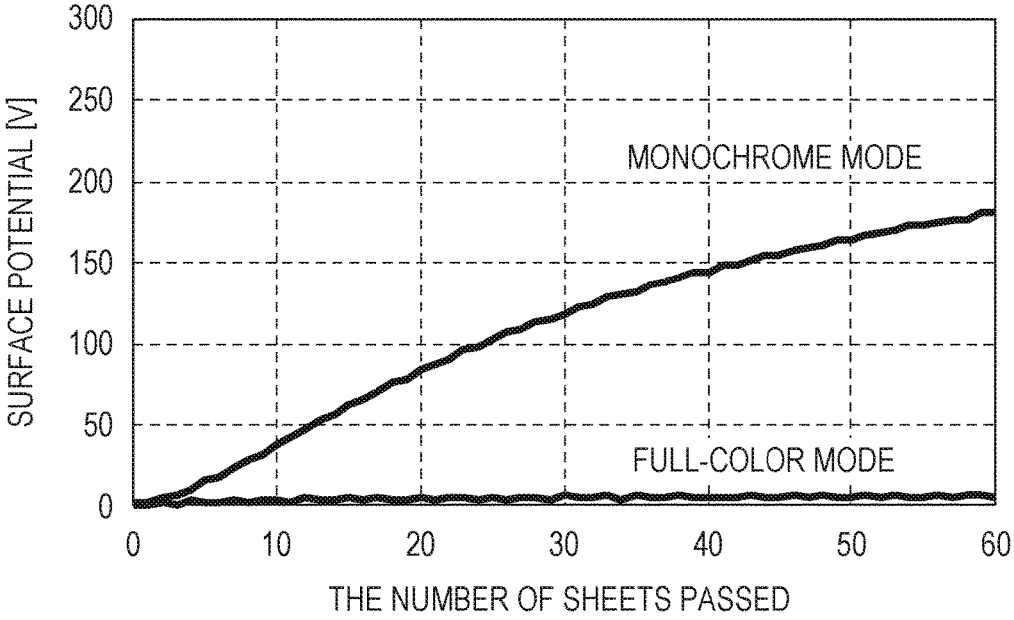
FIG. 8 is a graph showing measurement results of surface potential of an intermediate transfer member plotted as a function of the number of transfer media after 200000 sheets have been passed through an image-forming apparatus having a configuration of the first embodiment.

FIG. 8 is a graph showing measurement results of the surface potential of the intermediate transfer belt 20 plotted as a function of the number of transfer media P onto which evaluation images are formed during image quality evaluation after 200000 sheets have been passed in the sheet passing durability test. FIG. 8 shows that in the full-color mode, the increase of the surface potential of the intermediate transfer belt 20 is suppressed, whereas in the monochrome mode, the surface potential of the intermediate transfer belt 20 increases to approximately 180 V after 60 sheets are passed. This is because as the number of sheets passed increases, the electric resistance of the intermediate transfer belt 20 increases and thereby the electric charges accumulated in the intermediate transfer belt 20 becomes more difficult to remove.

TABLE 5

| The number of sheets passed | Output voltage of primary transfer power supply 40 a | b | c | d | Conductive brush 31 Target current value | Conductive roller 32 Target current value | Image quality evaluation 10 p | 20 p | 30 p | 40 p | 50 p | 63 p |
|---|---|---|---|---|---|---|---|---|---|---|---|---|
| 0 | — | — | — | 2100 V | 20 μA | 30 μA | A | A | A | A | A | A |
| 50000 | — | — | — | 2300 V | 20 μA | 30 μA | A | A | A | A | A | A |
| 100000 | — | — | — | 2500 V | 20 μA | 30 μA | A | A | A | A | A | A |
| 150000 | — | — | — | 2700 V | 20 μA | 30 μA | A | A | A | A | A | A |
| 200000 | — | — | — | 2900 V | 20 μA | 30 μA | A | A | A | A | B | C |

TABLE 6

| The number of sheets passed | Output voltage of primary transfer power supply 40 a | b | c | d | Conductive brush 31 Target current value | Conductive roller 32 Target current value | Image quality evaluation 10 p | 20 p | 30 p | 40 p | 50 p | 63 p |
|---|---|---|---|---|---|---|---|---|---|---|---|---|
| 0 | — | — | — | 2100 V | 20 μA | 30 μA | A | A | A | A | A | A |
| 50000 | — | — | — | 2300 V | 20 μA | 30 μA | A | A | A | A | A | A |
| 100000 | — | — | — | 2500 V | 20 μA | 30 μA | A | A | A | A | A | A |
| 150000 | — | — | — | 2700 V | 20 μA | 30 μA | A | A | A | A | A | A |
| 200000 | — | — | — | 2900 V | 5 μA | 15 μA | A | A | A | A | A | A |

Table 6 shows results of the image quality evaluation conducted per 50000 sheets that were passed in the sheet passing durability test in the monochrome mode of the present embodiment. The evaluation results are collated in Table 6 per 10 sheets in the image quality evaluation. Table 6 also shows the output voltage of the primary transfer power supply 40*d*, the target current value of the conductive brush 31, and the target current value of the conductive roller 32 when the image quality evaluation was conducted. As indicated in Table 6, in the present embodiment, the target current values of the conductive brush 31 and the conductive roller 32 were lowered to 5 μA and 15 μA, respectively, in a later stage of durability in which the number of sheets passed increased. As a result, image defects due to the faulty cleaning were not observed in the image quality evaluation even after 200000 sheets had been passed.

Figure 9:
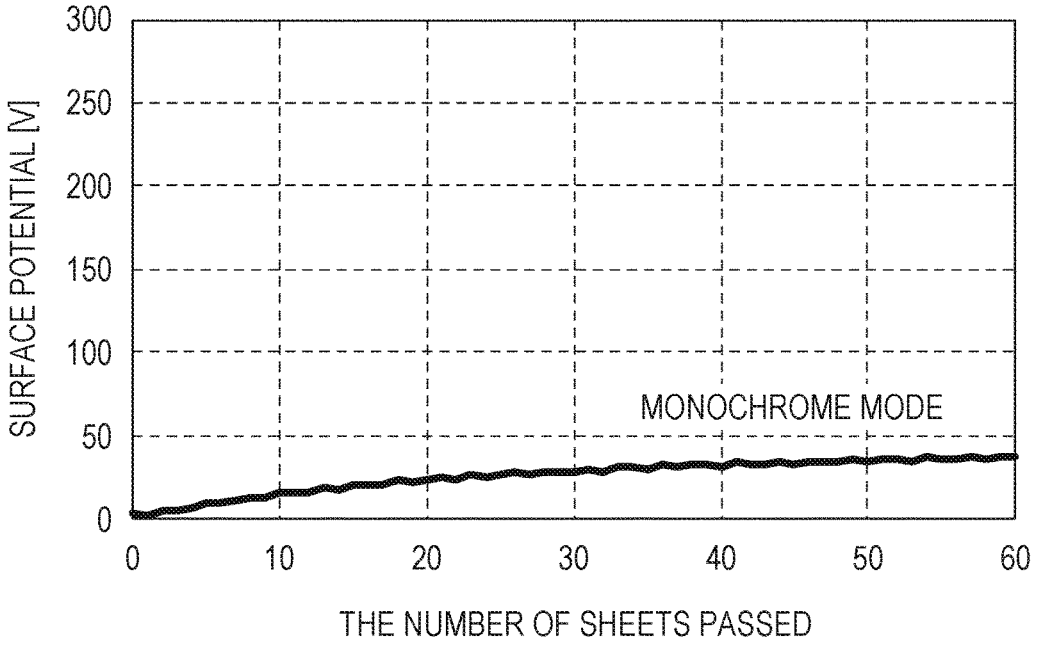
FIG. 9 is a graph showing measurement results of surface potential of an intermediate transfer member plotted as a function of the number of transfer media after 200000 sheets have been passed through an image-forming apparatus according to the second embodiment in a monochrome mode.

FIG. 9 is a graph showing measurement results of the surface potential of the intermediate transfer belt 20 plotted as a function of the number of transfer media P onto which evaluation images were formed during image quality evaluation after 200000 sheets had been passed in the sheet passing durability test in the monochrome mode of the present embodiment. In contrast to the results in FIG. 8, the increase of the surface potential of the intermediate transfer belt 20 is suppressed to approximately 40 V in the results in FIG. 9, which have been obtained by changing the target current values of the conductive brush 31 and the conductive roller 32.

The increase of the surface potential of the intermediate transfer belt 20 is subject to the electric currents flowing from the charging unit 30 and the primary transfer roller 5 to the intermediate transfer belt 20. Accordingly, the increase of the surface potential of the intermediate transfer belt 20 can be suppressed by decreasing the target current values of the electric current flowing from the charging unit 30 toward the intermediate transfer belt 20.

On the other hand, decreasing the target current values of the charging unit 30 degrades performance of charging residual toner. However, toner images that are primary-transferred to the intermediate transfer belt 20 in the monochrome mode are different from toner images of the full-color mode in which a plurality of color toners is overlain one over another. In the monochrome mode, the amount of the residual toner is smaller than that of the full-color mode. Accordingly, it is still possible to charge the residual toner even if the target current values of the charging unit 30 are lowered.

Note that both of the target current values of the conductive brush 31 and the conductive roller 32 are decreased in the present embodiment. However, either one of the target current values of the charging unit 30 may be decreased.

Modification Example

In the present embodiment, it has been described that the target current values of the charging unit 30 are changed in the later stage of durability in which the electric resistance of the intermediate transfer belt 20 increases. However, when performing the collection operation for residual toner in the monochrome mode, the target current values of the charging unit 30 may be set always lower than the target current values of the full-color mode regardless of the number of sheets passed. Thus, the voltages output by the charging power supply 51 and the charging power supply 52 can be set at lower levels, which can reduce the conduction degradation of the conductive brush 31 and the conductive roller 32.

While the disclosure has been described with reference to example embodiments, it is to be understood that the invention is not limited to the disclosed example embodiments. The scope of the following claims is to be accorded the broadest interpretation so as to encompass all such modifications and equivalent structures and functions.

This application claims the benefit of Japanese Patent Applications No. 2017-149278 filed Aug. 1, 2017, and No. 2018-099170 filed May 23, 2018, which are hereby incorporated by reference herein in their entirety.

What is claimed is:

1. An image-forming apparatus, comprising:

a first image bearing member that bears a toner image;

a second image bearing member that bears a toner image;

an intermediate transfer member that is movable and onto which a toner image born by at least one of the first image bearing member and the second image bearing member is primary-transferred;

a first transfer member that is in contact with an inner peripheral surface of the intermediate transfer member and is disposed at a position corresponding to the first image bearing member;

a first power supply that applies a voltage to the first transfer member;

a charging unit that is in contact with an outer peripheral surface of the intermediate transfer member and is disposed, with respect to a movement direction of the intermediate transfer member, downstream of a secondary transfer portion where the toner image is secondary-transferred from the intermediate transfer member onto a transfer medium and that charges toner that has passed the secondary transfer portion with opposite polarity that is opposite to a normal charging polarity of the toner; and a control unit that can perform a collection operation in which the toner charged with the opposite polarity by the charging unit is moved from the intermediate transfer member to any one of the first and second image bearing members that are in contact with the intermediate transfer member, wherein the control unit performs the collection operation by causing the first power supply to apply a first voltage that is a voltage having the opposite polarity to the first transfer member in a first state in which the first image bearing member and the second image bearing member are in contact with the intermediate transfer member, and the control unit performs the collection operation by causing the first power supply to apply a second voltage that is a voltage having the opposite polarity and higher in absolute value than the first voltage to the first transfer member in a second state in which the first image bearing member is in contact with the intermediate transfer member and the second image bearing member is separated from the intermediate transfer member.

2. The image-forming apparatus according to claim 1, further comprising a charging power supply that applies a voltage having the opposite polarity to the charging unit and thereby charges toner that has passed the secondary transfer portion with the opposite polarity, wherein in the first state, the control unit controls the charging power supply and thereby causes a first electric current to flow from the charging unit toward the intermediate transfer member, and in the second state, the control unit controls the charging power supply and thereby causes a second electric current that is smaller in absolute value than the first electric current to flow from the charging unit toward the intermediate transfer member.

3. The image-forming apparatus according to claim 2, wherein the charging power supply applies a voltage having the opposite polarity to the charging unit and thereby causes the second electric current to flow from the charging unit toward the intermediate transfer member in the second state after the number of transfer media onto which toner images are secondary-transferred in the secondary transfer portion exceeds a predetermined number of sheets.

4. The image-forming apparatus according to claim 2, further comprising a current detection unit that detects a value of an electric current flowing in the charging unit when the charging power supply applies a voltage to the charging unit, wherein the control unit controls the charging power supply in such manner that an electric current detected by the current detection unit becomes a predetermined current value and the control unit thereby causes the charging power supply to apply a voltage having the opposite polarity to the charging unit.

5. The image-forming apparatus according to claim 1, wherein the control unit causes the first power supply to apply the second voltage to the first transfer member in the second state after the number of transfer media onto which toner images are secondary-transferred in the secondary transfer portion exceeds a predetermined number of sheets, and if the number of transfer media does not exceed the predetermined number of sheets, the control unit causes the first power supply to apply the first voltage to the first transfer member in the second state.

6. The image-forming apparatus according to claim 1, wherein the collection operation is performed in such a manner that the first power supply applies a voltage having the opposite polarity to the first transfer member in the second state and thereby toner charged with the opposite polarity by the charging unit is moved from the intermediate transfer member to the first image bearing member while a toner image is primary-transferred from the first image bearing member to the intermediate transfer member.

7. The image-forming apparatus according to claim 1, further comprising a second transfer member that is in contact with the inner peripheral surface of the intermediate transfer member and is disposed at a position corresponding to the second image bearing member; and a second power supply that applies a voltage to the second transfer member, wherein the collection operation is performed in such a manner that the second power supply applies a voltage having the opposite polarity to the second transfer member in the first state and thereby toner charged with the opposite polarity by the charging unit is moved from the intermediate transfer member to the second image bearing member while a toner image is primary-transferred from the second image bearing member to the intermediate transfer member.

8. The image-forming apparatus according to claim 7, wherein the second transfer member is a metal roller and is disposed, with respect to a movement direction of the intermediate transfer member, at a position that deviates upstream or downstream of the position at which the second image bearing member is in contact with the intermediate transfer member.

9. The image-forming apparatus according to claim 7, further comprising a collection unit that is disposed, with respect to a rotation direction of the second image bearing member, downstream of a primary transfer portion where the second image bearing member is in contact with the intermediate transfer member and collects residual toner on the second image bearing member after the toner has passed the primary transfer portion, wherein the collection unit has a contact member that is in contact with the second image bearing member and that collects the residual toner on the second image bearing member into the collection unit, and when the collection operation is performed in the first state, the toner that is moved from the intermediate transfer member to the second image bearing member after the toner is charged with the opposite polarity by the charging unit is collected by the collection unit.

10. The image-forming apparatus according to claim 1, wherein the first image bearing member is disposed upstream of the secondary transfer portion and downstream of the second image bearing member with respect to a movement direction of the intermediate transfer member.

11. The image-forming apparatus according to claim 1, wherein the first image bearing member is an image bearing member that bears a toner image of black.

12. The image-forming apparatus according to claim 1, wherein the charging unit is a roller member having electroconductivity, and the roller member is in contact with the intermediate transfer member.

13. The image-forming apparatus according to claim 1, wherein the charging unit is a brush member having electroconductivity, and the brush member is in contact with the intermediate transfer member.

14. The image-forming apparatus according to claim 1, wherein the charging unit includes a roller member that has electroconductivity and a brush member that has electroconductivity and is disposed upstream of the roller member with respect to a movement direction of the intermediate transfer member, and the roller member and the brush member are in contact with the intermediate transfer member.

15. The image-forming apparatus according to claim 1, wherein the first transfer member is a metal roller and is disposed, with respect to a movement direction of the intermediate transfer member, at a position that deviates upstream or downstream of the position at which the first image bearing member is in contact with the intermediate transfer member.

16. The image-forming apparatus according to claim 1, further comprising a collection unit that is disposed, with respect to a rotation direction of the first image bearing member, downstream of a primary transfer portion where the first image bearing member is in contact with the intermediate transfer member and collects residual toner on the first image bearing member after the toner has passed the primary transfer portion, wherein the collection unit has a contact member that is in contact with the first image bearing member and that collects the residual toner on the first image bearing member into the collection unit, and when the collection operation is performed in the second state, the toner that is moved from the intermediate transfer member to the first image bearing member after the toner is charged with the opposite polarity by the charging unit is collected by the collection unit.

* * * * *